United States Patent [19]

Veil, Jr.

[11] Patent Number: 4,569,056

[45] Date of Patent: Feb. 4, 1986

[54] CONSUMABLE ELECTRODE REMELTING FURNACE AND METHOD

[75] Inventor: John W. Veil, Jr., Wyomissing, Pa.

[73] Assignee: Carpenter Technology Corporation, Reading, Pa.

[21] Appl. No.: 604,853

[22] Filed: Apr. 27, 1984

[51] Int. Cl.[4] ..... H05B 7/00

[52] U.S. Cl. ..... 373/70; 373/69; 373/49

[58] Field of Search ..... 373/67, 69, 70, 42, 373/52, 49, 50, 102, 105

[56] References Cited

U.S. PATENT DOCUMENTS

| | | | |
|---|---|---|---|
| 3,179,734 | 4/1965 | Redel et al. | 373/70 |
| 3,272,905 | 9/1966 | Wooding . | |
| 3,379,818 | 4/1968 | Wynne . | |
| 3,614,284 | 10/1971 | Scheidig et al. . | |
| 4,002,816 | 1/1977 | Zhupakhin et al. . | |
| 4,131,754 | 12/1978 | Roberts . | |
| 4,303,797 | 12/1981 | Roberts . | |

*Primary Examiner*—Roy N. Envall, Jr.

*Attorney, Agent, or Firm*—Edgar N. Jay

[57] ABSTRACT

An improved consumable electrode remelting furnace and a method of monitoring decreases in the weight of a consumable electrode during remelting are provided. An electrode support structure is movably supported above a mold for moving the electrode into and out of substantially coaxial relationship with the mold. The base of a load cell is supported above the mold by the electrode support structure so that the load cell is electrically remote from the electric melting current conducting paths in the furnace. Apparatus are provided for: (1) suspending the weight of the electrode and substantially only that weight from the top of the load cell; and (2) vertically displacing the mold and the electrode relative to each other toward and away from a position of the electrode in the mold where the electrode can be remelted. By this arrangement, the load cell is uniquely free from loading by masses other than those of the electrode and the apparatus used to suspend the electrode from the load cell and is uniquely free from electrical interference.

9 Claims, 3 Drawing Figures

CONSUMABLE ELECTRODE REMELTING FURNACE AND METHOD

BACKGROUND OF THE INVENTION

This invention relates to a consumable electrode remelting furnace, such as a vacuum arc remelting (VAR) furnace or an electroslag remelting (ESR) furnace, in which changes in the weight of the consumable electrode are monitored as the electrode is remelted. This invention particularly relates to such an improved furnace and a method of operating the same which lend themselves to more accurate control of melting rates during the remelting process.

In a consumable electrode remelting furnace, it is highly desirable to be able to monitor the decrease in the consumable electrode's weight as it is remelted in the furnace mold. This permits the remelting process to be closely watched as its end approaches, so that the process can be halted when as much as possible of the metal in the electrode has been remelted into an ingot but before the electrode holder or clamp at the top of the electrode has been exposed to the electric arc generated at the bottom of the electrode. It is also greatly desired to monitor the weight of the electrode, so that the melting current can be varied during the remelting process with reductions in the weight of the electrode so as to control: (1) the volume of the molten metal pool on the ingot being formed in the furnace mold; and (2) the metallurgical properties of the ingot.

However, such furnaces and methods of operating the same have left much to be desired in that they have failed to provide the desired degree of accuracy and reproducibility in monitoring the weight of consumable electrodes and have generally required systems that are relatively complicated and expensive to install and maintain in the furnaces. In this regard, it has been found to be particularly difficult to monitor the weight of an electrode in a VAR furnace. For example, in Wynne U.S. Pat. No. 3,379,818, granted Apr. 23, 1968, and Wooding U.S. Pat. No. 3,272,905, granted Sept. 13, 1966, one or more load cells for monitoring electrode weight have had to be mounted within a special protective hollow housing connecting the electrode ram and the electrode clamp in a VAR furnace. Besides the inherent difficulty and expense of installing and maintaining load cells in the required special housings, such arrangements have inevitably suffered adverse effects from electrical interference with the load cells' electrical output due to the load cells close physical proximity to the path of the extremely high electrical currents required to melt the electrodes. In Scheidig et al U.S. Pat. No. 3,614,284, granted Oct. 19, 1971, load cells for monitoring electrode weight have had to be positioned atop a VAR furnace under a special weighing platform which bears, besides the weight of the electrode, electrode ram and electrode clamp, the added weight of the motor and transmission that move the electrode, as well as the added weight of a current carrying cable (e.g., a total added weight estimated to be about 500 to 1,000 pounds for a furnace to remelt an electrode of up to about 10,000 pounds). Such added weight of the motor, transmission and cable has required the use of load cells with heavier weighing capacities, i.e., greater weight range, and less accuracy than load cells that could be used if such added weight were not borne by the load cells.

There has been a need, therefore, for simpler and more accurate ways of monitoring the weight of an electrode in a consumable electrode remelting furnace.

SUMMARY OF THE INVENTION

In accordance with this invention, an improved consumable electrode remelting furnace is provided in which an electrode support structure is movably supported above a mold for moving the electrode into and out of substantially coaxial alignment with the mold. Motive means are provided for vertically displacing the mold and the electrode relative to each other toward and away from a position of the electrode in the mold where the electrode can be remelted. The base of a load cell means is supported above the mold by the electrode support structure, and means are provided for suspending the weight of the electrode and substantially only that weight from the top of the load cell means, so that the load cell means has a unique degree of freedom from loading by masses other than those of the electrode and the means for suspending the electrode from the load cell means. By this invention, a load cell means for monitoring the weight of a consumable electrode can be easily and inexpensively installed and maintained in the electrode support structure of a conventional consumable electrode remelting furnace. In accordance with a further feature of this invention, the load cell means is electrically remote from the electric melting current conducting paths in the furnace, and thereby, the load cell means has a unique degree of freedom from electrical interference.

DETAILED DESCRIPTION OF THE INVENTION

Figure 1:
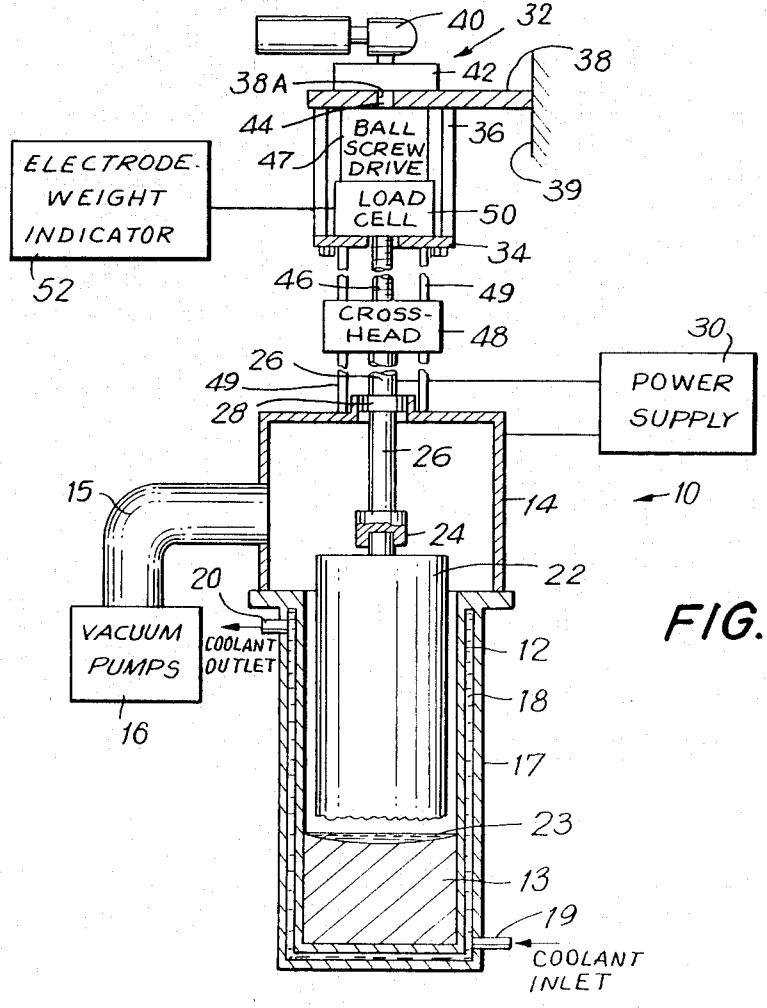
FIG. 1 is a schematic drawing of a VAR furnace having a load cell means installed in an electrode support structure above the mold of the furnace in accordance with this invention. Portions of the furnace and the electrode support structure have been cut away along the vertical axis of the furnace.

FIG. 1 schematically shows a VAR furnace, generally 10. The furnace 10 comprises: a conventional, vertically aligned, cylindrical, open top crucible or mold 12, in which a cylindrical ingot 13 is being formed; and a conventional removable cylindrical head or shell 14 forming a closure above the mold 12. A vacuum is maintained within the mold 12 and shell 14 by means of a pipe 15 that is connected to conventional vacuum pumps 16 and is in communication with the interior of the shell 14 above the mold 12. A conventional cylindrical jacket 17 is provided concentrically about the mold 12. The jacket 17 is spaced from the mold 12 to provide an annular space 18 through which a coolant (e.g., water) can flow between a coolant inlet 19 and a coolant outlet 20 in the jacket 17.

In the furnace 10 as shown in FIG. 1, a vertically aligned, cylindrical, consumable electrode 22 is supported, so that its bottom portion is within the mold 12 a predetermined distance above a molten metal pool 23 maintained on the solidified metal of the ingot 13 as the electrode is remelted to form the ingot. The electrode 22 is supported within the mold 12 by a clamp 24 that is attached to the top of the electrode 22 and to the bottom of a conventional, vertically aligned, hollow, tubular, electrode holder or ram 26. Preferably, the vertical axes of the ram 26 and electrode 22 are substantially vertically aligned. The ram 26 extends through a central, vertically extending aperture in a conventional vacuum seal 28 at the top of the furnace shell 14. The seal 28 is substantially vacuum tight and prevents gases from entering or leaving the shell 14 but allows the ram 26 to move vertically up or down relative to the shell, as desired, without significant hindrance. Electrical power is supplied to the furnace 10 by a suitable power supply 30 connected to the ram 26 and connected through the shell 14 to the mold 12. The shell 14 is adapted to be lifted off of the mold 12, so that a fresh electrode 22 can be attached to the clamp 24 and the ingot 13 can be removed from the mold 12.

FIG. 1 also schematically shows a conventional rigid electrode support structure, generally 32, positioned above the mold 12 and shell 14 of the furnace 10. As described in detail below, the electrode support structure 32 is connected to the top of the ram 26 so that it bears the weight of the ram 26 and electrode 22 and supports the electrode 22 within the mold 12 and shell 14. The electrode support structure 32 comprises: a rigid base member 34; a plurality of rigid vertical columns 36 connected to the base member 34; and a rigid top member 38. The top member 38 is movably anchored to a superstructure 39 about the furnace 10 and is connected to the top of each column 36 to fixedly support the columns 36 and base member 34 above the mold 12 and shell 14. Mounted on the top member 38 are one or more, conventional, variable speed and variable direction, electric motors 40 and a conventional transmission 42 connected to the motors 40. The top member 38 supports the entire weight of the motors 40 and transmission 42, as well as a vertically aligned, output shaft 44 of the transmission. The motors 40 are connected through the output shaft 44 of the transmission 42 to the top of the ram 26, so that the motors can raise and lower the electrode 22 in the mold 12 as described in detail below. The electrode support structure 32 is adapted to be moved with the ram 26, motors 40 and transmission 42: (1) toward the mold 12 to move a fresh electrode 22 into substantially coaxial relationship with the mold 12; and (2) away from the mold 12 when the remainder of a remelted electrode 22 on the clamp 24 is to be moved out of its substantially coaxial relationship with the mold, a fresh electrode 22 is to be attached to the clamp 24 and an ingot 13 is to be removed from the mold 12.

Figure 2:
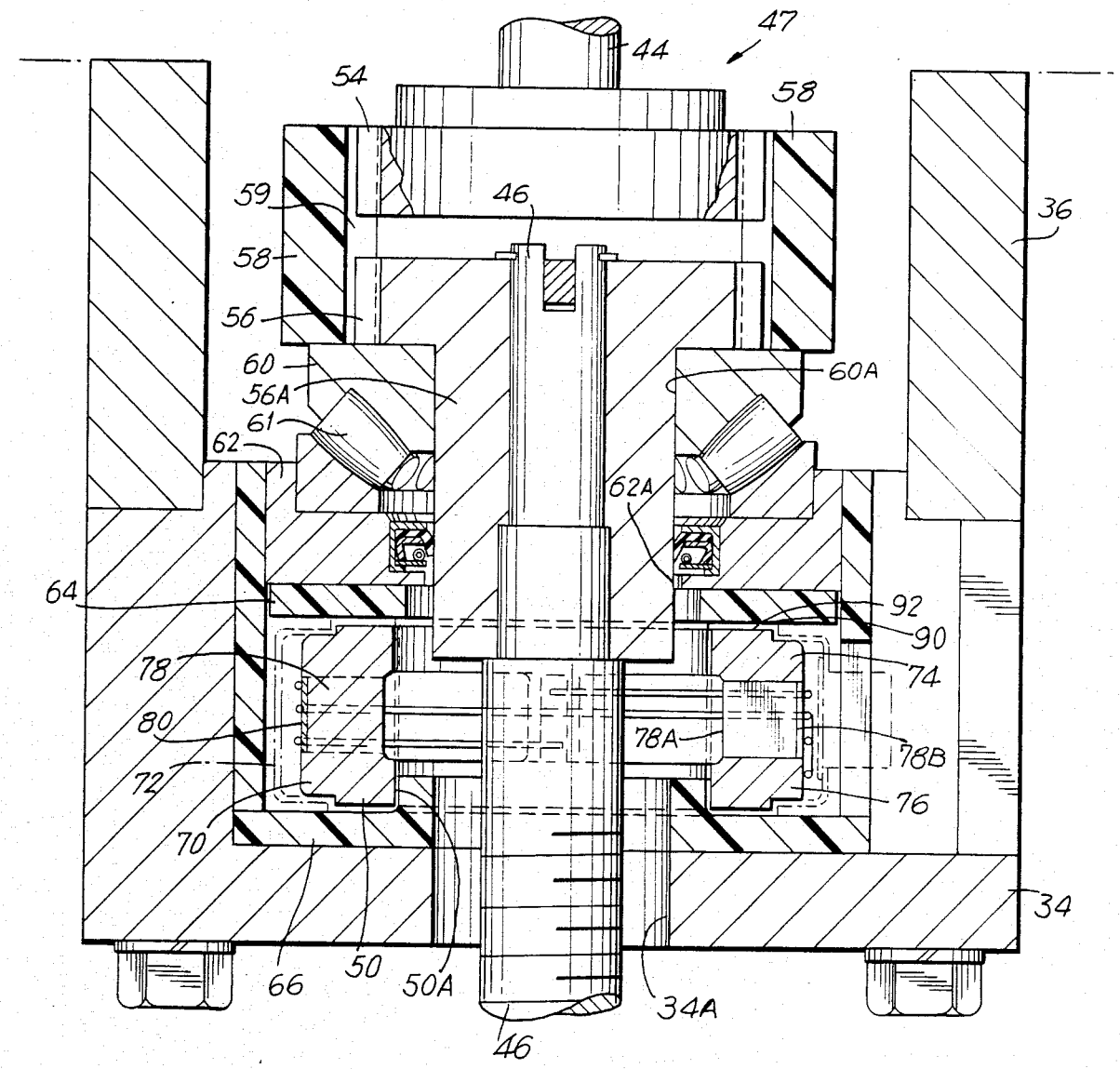
FIG. 2 is a detailed schematic plan view of portions of the electrode support structure of FIG. 1 containing a unitary annular-shaped load cell. Portions of the electrode support structure and the load cell have been cut away along the vertical axis of the load cell.

As also shown in FIG. 1, the output shaft 44 of the transmission 42 extends vertically downwardly through an aperture 38A in the top member 38 and is connected to the upper portion of a conventional, vertically aligned, threaded spindle or ball screw 46 by means of a ball screw drive, generally 47. The ball screw drive 47, which is shown in FIG. 2 and will be described in detail below, is adapted to cause the ball screw 46 to rotate about its vertical axis with rotation of the output shaft 44 about its vertical axis. The lower portions of the ball screw 46 are connected to the top of the ram 26 by means of a crosshead 48 containing a conventional ball nut (not shown) which is: (1) rotatably mounted about, and in threaded engagement with, the lower portions of the ball screw 46; and (2) fixedly mounted about the top of the ram 26. The outer diameter of the lower portions of the ball screw 46 is smaller that the inner diameter of the upper portions of the ram 26, so that the lower portions of the ball screw 46 can be moved vertically inward and outward of the upper portions of the hollow interior of the ram 26 when screwed in and out of the ball nut in the crosshead 48. The lateral ends of the crosshead 48 have a pair of vertically extending, guide sleeves (not shown), through which a pair of vertical rods 49, on opposite lateral sides of the crosshead 48, extend. The ends of the vertical rods 49 are fixedly connected to the shell 14 and the electrode support structure 32, so that the rods 49 prevent the crosshead 48 and its ball nut from rotating about the vertical axis of the ball nut with rotation of the ball screw 46 about its vertical axis. The vertical rods 49 fits loosely within the guide sleeves in the crosshead 48, so that the crosshead 48 is free to slide vertically, without hindrance, along the rods 49 with vertical movement of the ram 26. By this arrangement of elements, when the motors 40 and transmission 42 cause the output shaft 44 and the ball screw 46 to rotate about their respective vertical axes: (1) the ball screw 46 is screwed either (a) out of the crosshead 48 and its ball nut or (b) into the crosshead and ball nut; (2) thereby the crosshead 48 moves either (a) downwardly or (b) upwardly; and (3) thereby the ram 26 and electrode 22 are moved vertically with the crosshead 48 either (a) downwardly or (b) upwardly as the lower portions of the ball screw 46 move either (a) outwardly or (b) inwardly of the hollow interior of the upper portions of the ram 26.

Figure 3:
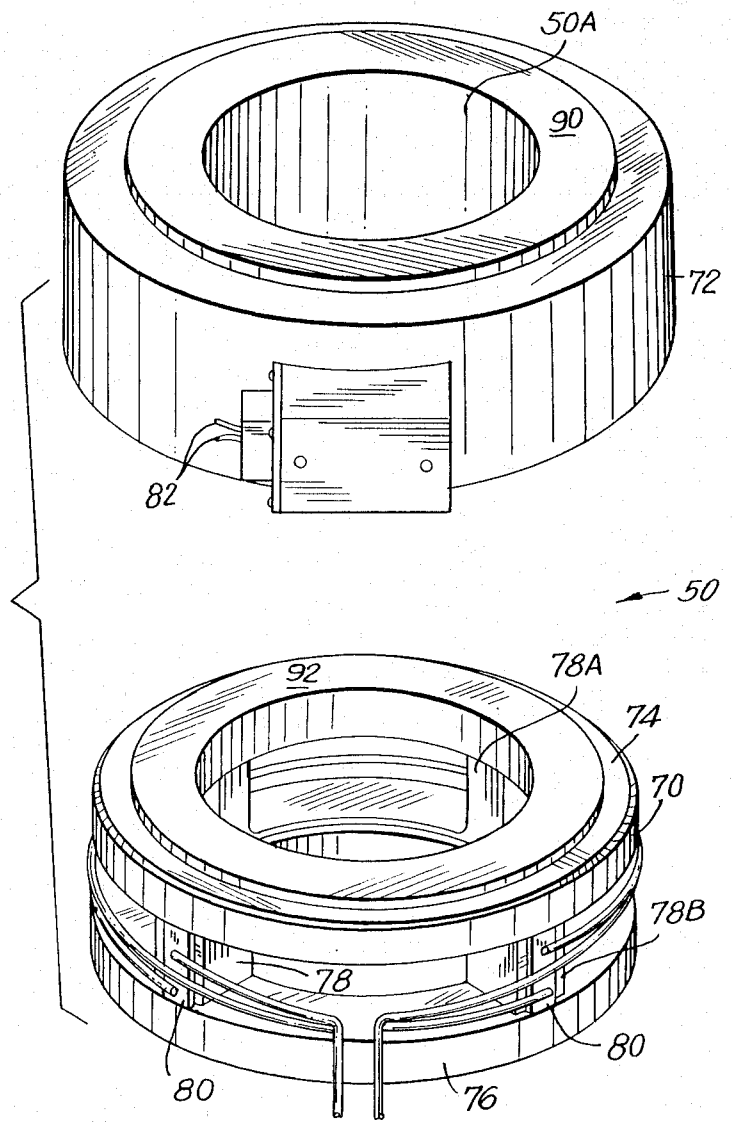
FIG. 3 is a partial exploded perspective schematic view of the annular-shaped load cell shown in FIG. 2.

As shown in FIG. 1, load cell means, generally 50, are fixedly positioned above the furnace mold 12, within the electrode support structure 32 and beneath the ball screw drive 47. As shown in FIGS. 2 and 3, the load cell means 50 preferably comprises a unitary annular-shaped load cell 50 having a central circular aperture 50A extending vertically through it. Details of the structure of the annular-shaped load cell 50 are shown in FIGS. 2 and 3 as described below. The ball screw 46 extends vertically through the load cell aperture 50A, and preferably, the vertical axes of the ball screw 46, electrode 22 and load cell aperture 50A, as well as ram 26, are substantially vertically aligned.

In accordance with this invention, the base or bottom of the load cell means 50 sits upon, and is supported by, the rigid base member 34 of the electrode support structure 32, and the bottom of the ball screw drive 47 sits upon, and is supported by, the top of the load cell 50 as shown in FIG. 1. As described in detail below with reference to FIG. 2, it is preferred that the weight of the electrode 22, ball screw 46, crosshead 48, ram 26, clamp 24 and certain portions of the ball screw drive 47 be applied by the bottom of the ball screw drive 47 to the top of the unitary annular-shaped load cell 50, preferably so that the weight on the top of the load cell 50 is distributed symmetrically about the vertical axis of its central aperture 50A. The load cell 50 preferably acts as a conventional strain gauge, the vertical dimensions and electrical resistance of which change as the total weight applied to the top thereof by the bottom of the ball screw drive 47 decreases as the weight of the consumable electrode 22 decreases during remelting of the electrode in furnace mold 12. In this regard, changes in the weight of the electrode 22 during remelting are indicated by a conventional electrode weight indicator 52 which is electrically connected to the load cell 50 to provide the desired output representative of the weight of the electrode, as is well known.

Shown in detail in FIG. 2 are portions of the electrode support structure 32 and, within it, the ball screw drive 47 and the annular-shaped load cell 50. The ball screw drive 47 comprises an upper annular driving member 54 and a lower annular driven member 56. The top of the driving member 54 is connected to the output shaft 44 of the transmission 42, so that the entire weight of the driving member 54 is supported by the output shaft 44 and the driving member rotates about its vertical axis with rotation of the output shaft 44 about its vertical axis. The driving member 54 is connected to the driven member 56 of the ball screw drive 47 by means of a conventional, flexible, tubular, vertically aligned, plastic (e.g., nylon), coupling sleeve 58 about the periphery of the driving and driven members 54 and 56. The inner surface of the sleeve 58 is provided with a plurality of radially inwardly extending, vertical ribs 59 which engage a plurality of mating, radially inwardly extending, vertical grooves (not shown) in the peripheral or outer surfaces of the driving and driven members 54 and 56. The sleeve 58 causes the driven member 56 to rotate about its vertical axis with rotation of the driving member 54 about its vertical axis, without the sleeve 58 weighing upon the driven member 56 or supporting any of the weight of the driven member 56.

FIG. 2 also shows the top of the ball screw 46 connected to, and mounted within, the driven member 56, so that the ball screw 46 is supported by the driven member 56 and both rotate about a common vertical axis. Below the connection of the ball screw 46 with the driven member 56, the ball screw 46 and the surrounding downwardly extending portions 56A of the driven member 56 extend sequentially through a central circular passageway 60A in a conventional self-aligning bearing 60 that contains a plurality of bearings 61 and is located beneath the sleeve 58, through a central opening 62A in a conventional annular bearing support assembly 62, through an upper annular plastic electrical insulator 64 beneath the bearing support assembly 62, and through the central aperture 50A in the annular-shaped load cell 50 beneath the upper insulator 64. The ball screw 46 further extends downwardly through a lower annular plastic electrical insulator 66 beneath the load cell 50 and then through an aperture 34A in the base member 34 beneath the lower insulator 66. As also seen from FIG. 2, the sleeve 58 is supported by the bearing 60 and maintained by the bearing in engagement with the driving member 54 and driven member 56.

In accordance with this invention, the use of a particular load cell means 50 is preferred and is advantageously used. However, other conventional load cells can be used. The preferred unitary annular-shaped load cell 50 is made and sold by Eaton Corporation, Electronic Instrumentation Division, Troy, Michigan under the trade designation Lebow Products model No. 3632-118 and is shown in FIGS. 2 and 3.

The unitary annular-shaped load cell 50 of FIGS. 2 and 3 comprises a one-piece, high strength (e.g., steel), load bearing, annular-shaped core 70 within a sealed, sheet metal (e.g., steel), annular-shaped housing 72 that fits to close tolerances about the top and bottom of the core 70. The core 70 essentially comprises an upper annular-shaped member 74, a lower annular-shaped member 76, and four pillars 78 extending between the upper and lower members 74 and 76. The pillars 78 are spaced equidistantly about the vertical axis of the central aperture 50A of the load cell 50 so as to substantially uniformly distribute the load between the upper and lower annular members 74 and 76. The inner and outer surfaces 78A and 78B, respectively, of each pillar 78 are recessed from the inner and outer surfaces, respectively, of the upper and lower members 74 and 76. Vertically mounted on, and bonded to, the outer surface 78B of each pillar 78 is a strain gauge 80 (e.g., a conventional, 120 ohm resistance, foil-type, strain gauge). The strain gauges 80 on the four pillars 78 are electrically connected in a known way, for example, in a balanced Wheatstone bridge circuit (e.g. as shown and described in Stover U.S. Pat. No. 3,461,715, granted Aug. 19, 1969, and Stover U.S. Pat. No. 3,541,844, granted Nov. 24, 1970) to provide a unitary output to the electrode weight indicator 52 across the wires 82 on the outside of the housing 72.

As best shown in FIG. 3, a flat annular surface 90 is preferably provided at the top of the housing 72 of the unitary annular-shaped load cell 50 about the central aperture 50A, and a mating flat annular surface 92 is provided at the top of the core 70 of the load cell 50. The flat annular top surfaces 90 and 92 are each perpendicular to the vertical axis of the load cell 50. The flat annular top surface 92 of the core 70 fits to close tolerances beneath the flat annular top surface 90 of the housing 72. Corresponding flat annular surfaces (not shown) are preferably also provided on the bottom of the core 70 and housing 72 about the central aperture 50A.

As seen from FIG. 2, within the electrode support structure 32: the lower insulator 66 is supported by the base member 34; the flat annular bottom surface of the load cell housing 72 is supported by the lower insulator 66; the upper insulator 64 is supported by the flat annular top surface 90 of the load cell housing 72; the bearing support assembly 62 is supported by the upper insulator 64; the self-aligning bearing 60 is supported by the bearing support assembly 62; the driven member 56 of the ball screw drive 47 is supported by the bearing 60, preferably so that the vertical axes of the driven member 56 and ball screw 46 are kept vertically aligned with the vertical axis of the central aperture 50A of the load cell 50; and the sleeve 58 is supported by the bearing 60. As a result, the electrode 22, together with the means for suspending the electrode from the top of the load cell 50 (i.e., the driven member 56, upper insulator 64, bearing support assembly 62, bearing 60, ball screw 46, crosshead 48, ram 26 and clamp 24) are supported by, and weigh upon, the top surface 90 of the load cell 50, preferably symmetrically about the vertical axis of the load cell 50. The weight on the top surface 90 of the load cell 50 is transmitted by the bottom surface of the load cell housing 72, preferably symmetrically about the vertical axis of the load cell 50, to the base member 34 through the lower insulator 66.

This arrangement of elements in the furnace 10 and electrode support structure 32 permits the load cell 50 to monitor continuously changes in the weight of the electrode 22 while it is being remelted in the furnace mold 12.

It is thought that the invention and many of its attendant advantages will be understood from the foregoing description, and it will be apparent that various changes can be made in the load cell 50 and the consumable electrode remelting furnace 10, described therein, without departing from the spirit and scope of the invention or sacrificing all of its material advantages, the embodiments hereinbefore described being merely preferred embodiments of the invention. For example, the VAR furnace 10 and its mold 12, shell 14 and electrode 22 need not be cylindrical and can have any conventional cross-sectional shape, besides circular, such as square or rectangular. Also, the furnace 10 can be an ESR furnace, and its mold 12 can be moved upwardly towards its consumable electrode 22 during remelting. In this regard, any motors 40 and transmission 42 for moving an ESR furnace mold 12 upwarwardly can be supported by the furnace superstructure 39 beneath, rather than above, the electrode support structure 32 and the consumable electrode 22.

What is claimed is:

1. A consumable electrode remelting furnace comprising:

(a) a mold for remelting a consumable electrode;

(b) electrode support means movably supported above said mold for moving said electrode into and out of substantially coaxial relationship with said mold;

(c) load cell means supported on one side by said electrode support means above said mold; said one side of said load cell means facing said mold; said load cell means being adapted to provide a signal representative of the weight applied to the side of said load cell means opposite said one side;

(d) means for suspending substantially solely said electrode from said opposite side of said load cell means;

(e) motive means for vertically displacing said mold and said electrode relative to each other toward and away from a position of said electrode in said mold where said electrode can be remelted; and (f) electric melting current conducting means and means for connecting the same to said mold and to said electrode on the side of said electrode remote from said load cell means.

2. The furnace of claim 1 wherein said load cell means comprises a unitary annular-shaped load cell having a central aperture extending vertically through it.

3. The furnace of claim 2 wherein said load cell has a flat annular surface at its top that is perpendicular to the vertical axis of the central aperture of said load cell; and wherein said electrode is suspended from the top flat surface of said load cell.

4. The furnace of claim 2 wherein said suspending means extends vertically through the central aperture of said load cell.

5. The furnace of claim 4 wherein said load cell comprises a one-piece core which includes an upper annular-shaped member, a lower annular-shaped member, and a plurality of pillars spaced equidistantly about the vertical axis of the central aperture of the load cell between the upper and lower members; each pillar of the core having a strain gauge mounted vertically on it.

6. The furnace of claim 4 wherein said suspending means comprises:

a vertically aligned ram, the bottom of which is connected to the top of the electrode; and a vertically aligned ball screw, the lower portions of which are rotatably connected to, and threadedly engaged with, the upper portions of the ram so that the lower portions of the ball screw and the upper portions of the ram can be moved toward and away from each other by rotating the ball screw about its vertical axis; and wherein said motive means comprises means for rotating the ball screw about its vertical axis.

7. The furnace of claim 6 wherein the ball screw extends through the central aperture of said load cell.

8. The furnace of claim 7 wherein said means for rotating the ball screw is supported by a self-aligning bearing having a central, vertically extending passageway through which the ball screw extends; and wherein the bearing is supported by the top flat surface of said load cell.

9. The furnace of claim 8 wherein said means for rotating the ball screw is supported by said electrode support means; and wherein said load cell is located within said electrode support means and beneath said means for rotating the ball screw.

* * * * *